United States Patent [19]

Pockrandt et al.

[11] 4,115,079

[45] Sep. 19, 1978

[54] REMOVING POLLUTANTS FROM AQUEOUS LIQUOR USED TO SCRUB FUEL GASIFICATION PRODUCT

[75] Inventors: Günter Pockrandt, Bad Homburg; Helmut Fellner, Frankfurt am Main, both of Germany

[73] Assignee: Metallgesellschaft Aktiengesellschaft, Frankfurt am Main, Germany

[21] Appl. No.: 789,302

[22] Filed: Apr. 20, 1977

[30] Foreign Application Priority Data

Apr. 22, 1976 [DE] Fed. Rep. of Germany ..... 2617648

[51] Int. Cl.[2] ..... B01D 19/00

[52] U.S. Cl. ..... 55/43 BN; 48/197 R; 55/70; 55/73; 423/574 G

[58] Field of Search ..... 48/197 R, 202, 206, 48/215; 55/39, 40, 43, 68, 70, 73; 423/574 G

[56] References Cited

U.S. PATENT DOCUMENTS

| | | | |
|---|---|---|---|
| 1,518,784 | 12/1924 | Gibson | 55/39 |
| 2,315,481 | 3/1943 | Drewry et al. | 55/39 |
| 3,079,238 | 2/1963 | Handwerk | 423/574 G |
| 3,193,986 | 7/1965 | Forster | 55/43 |
| 3,266,220 | 8/1966 | Woertz | 55/68 |
| 3,709,669 | 1/1973 | Marion et al. | 48/215 |
| 3,880,615 | 4/1975 | Grunewald et al. | 55/73 |
| 3,910,777 | 10/1975 | Jakob | 55/68 |
| 3,972,693 | 8/1976 | Wiesner et al. | 55/68 |
| 3,975,172 | 8/1976 | Ranke | 55/40 |
| 4,011,066 | 3/1977 | Bratzler et al. | 55/70 |

*Primary Examiner*—S. Leon Bashore
*Assistant Examiner*—George C. Yeung
*Attorney, Agent, or Firm*—Burgess, Dinklage & Sprung

[57] ABSTRACT

A process of treating an aqueous liquor which has been used to scrub a hot raw gas produced by the gasification of a solid, liquid or gaseous fuel, which liquor has dissolved therein gaseous pollutant, comprising flashing said liquor from a temperature of at least 100° C and a pressure of at least about 5 bars in at least on preliminary flashing stage to an intermediate pressure in the range of about 1.1 to 4 bars, separating the flashed-off gases containing the bulk of the pollutants from the residual aqueous liquor, and then flashing off the residual liquor to atmospheric pressure. The pollutant gas may contain $H_2S$ and the gas product of the preliminary flashing can be fed to a Claus process for removing sulfur compounds.

5 Claims, 1 Drawing Figure

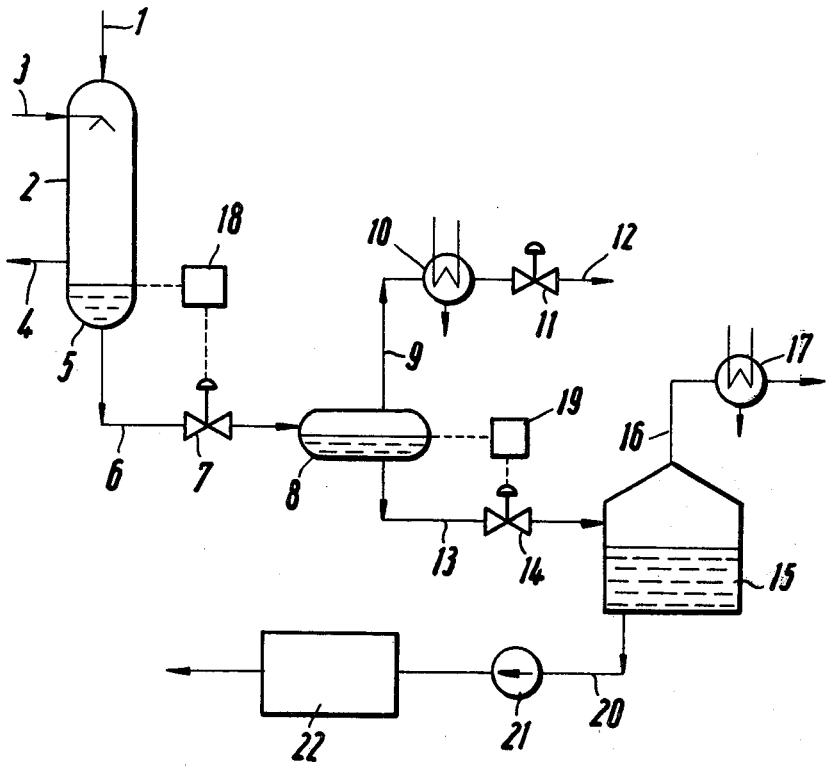
1
2
3
4
5
6
7
8
9
10
11
12
13
14
15
16
17
18
19
20
21
22

REMOVING POLLUTANTS FROM AQUEOUS LIQUOR USED TO SCRUB FUEL GASIFICATION PRODUCT

This invention relates to a process of treating aqueous liquors which have been used to scrub a hot raw gas produced by the gasification of solid, liquid or gaseous fuel, which aqueous liquor is withdrawn at a temperature of at least about 100° C from a scrubbing vessel, in which water has been directly contacted with the raw gas under a pressure of at least about 5 bars.

It is known to produce a gas from solid, liquid or gaseous fuels by gasification under pressure, with or without a catalyst. For instance, it is known to produce a gas from liquid or gaseous hydrocarbons by a treatment thereof with oxygen and water vapor at elevated temperatures. This treatment results in a partial oxidation involving temperatures in the range of about 1000° to 1500° C. The resulting raw gases can be processed to form a fuel gas or synthesis gas. Such a process has been described, for example, in Printed German Application No. 2,117,236. The production of a gas by the gasification of gaseous or liquid hydrocarbons at temperatures of about 800° to 1100° C by means of a catalyst is known from U.S. Pat. No. 2,585,737.

It is also known to gasify granular coal under pressure in a fixed bed in the known "Lurgi Gas Producer" by a countercurrent treatment with gasifying agents consisting of oxygen and water vapor (U.S. Pat. Nos. 3,930,811; 3,902,872; 3,937,620).

In the known gasification processes resulting in a gas, the hot raw gas which is discharged under pressure from the reaction zone is first contacted with sprayed or trickling water for a removal of carbon black or undesired gaseous constituents. Because the used aqueous liquor contains disturbing quantities of polluting compounds, such as $H_2S$, HCN, $NH_3$, CO and HCOOH, problems arise in the further processing thereof. It is accordingly an object of the invention to simplify and ecologically improve the further treatment and processing of the used aqueous liquor. This object is realized in accordance with the present invention pursuant to which the aqueous liquor which has been withdrawn is flashed in at least one preliminary flashing stage to an intermediate pressure in the range of about 1.1 to 4 bars, flashed-off gases are discharged and the aqueous liquor is then flashed to atmospheric pressure. A major part of the gases which are physically dissolved in the aqueous liquor is released by the preliminary flashing and can then be fed, e.g., to a Claus process plant. The subsequent flashing to atmospheric pressure involves a release of only a relatively slight superatmospheric pressure but nevertheless results in an escape of a considerable quantity of water vapor because the vapor pressure curve is non-linear. The aqueous liquor which has been flashed from the intermediate pressure to atmospheric pressure contains only small residual gas constituents and these can be released jointly with the water vapor. The remaining flashed-off gas, which has a high water vapor content, may be processed separately from the gas that has been flashed off by the preliminary flashing and can be discharged into the atmosphere, e.g., through an afterburner. On the other hand, if the aqueous liquor were flashed to atmospheric pressure without a preliminary flashing, the flashed water would have a 100 to 200 times higher content of disturbing gas constituents, particularly $H_2S$. These gases would be finally released in the sewage treating plant and would give rise to considerable ecological problems.

The preliminary flashing to a still superatmospheric pressure may be effected in one stage or a plurality of stages. One preliminary flashing stage will usually be sufficient. The aqueous liquid which has been withdrawn from the scrubber is usually flashed in one or more flashing stages to an intermediate pressure in the range of about 1.2 to 3 bars and only thereafter is flashed to atmospheric pressure.

An example of the process according to the invention will be explained with reference to the drawing which is a schematic flow sheet of the process.

A hot gas which has been produced under pressure enters a scrubbing vessel 2 through conduit 1 and in the vessel is contacted with sprayed or trickling hot water, which is fed through conduit 3. A pressure of at least about 5 bars and usually in the range of about 10 to 80 bars is maintained in the vessel 2. The raw gas which has been treated leaves the vessel 2 through a conduit 4.

The aqueous liquor is collected in a sump 5 of the vessel 2 and is withdrawn through a conduit 6. Under the control of a control valve 7, the aqueous liquor is fed to a preliminary flashing vessel 8, in which a pressure of 1.1 to 4 bars, preferably 1.2 to 3 bars, is maintained.

The gases which have been flashed off in the vessel 8 leave the latter through a conduit 9 and are sufficiently cooled in a heat exchanger 10 for a condensation of a major part of the water vapor. The flashed-off gases flow finally through a pressure control valve 11 in a conduit 12 to a known Claus process plant, in which sulfur-containing gas constituents, $H_2S$ and $SO_2$, are converted to elementary sulfur.

After the preliminary flashing in the vessel 8, the aqueous liquor is fed through a conduit 13 and another control valve 14 into a storage tank 15. The small pressure relief between the vessel 8 and the tank 15 results in a release of considerable quantities of water vapor but hardly of any disturbing gas constituents. The only slightly contaminated water vapor which has been flashed off is discharged from tank 15 in a conduit 16 and is then condensed in a heat exchanger 17 whereas the residual gases are fed to an afterburner.

Liquid level control devices 18 and 19 control the control valves 7 and 14, respectively, in known manner in order to maintain the liquid levels in the scrubbing vessel 2 and the preliminary flashing vessel 8.

The solids-containing water which has been flashed is fed from the storage tank 15 in a conduit 20 to a sewage treatment plant 22 by means of a pump 21 and in the plant 22 is sufficiently purified so that it can be finally discarded and/or recycled to the process.

The process is further described in the following illustrative example wherein the apparatus of the drawing is employed.

EXAMPLE

The thermal gasification of heavy fuel oil by a treatment with oxygen and water vapor at temperatures up to about 1400° C and a pressure of 34 bars results in a raw gas having the following composition in % by volume:

| | |
|---|---|
| $CO_2$ | 4.9 |
| CO | 45.4 |
| $H_2$ | 47.6 |
| $CH_4$ | 0.3 |

-continued

| | |
|---|---|
| $N_2$ + Ar | 1.3 |
| $H_2S$ | 0.49 |
| COS | 0.01 |

The raw gas also contains small quantities of $NH_3$ and HCN.

Under the gasification pressure, the raw gas is scrubbed with water. The aqueous liquor is withdrawn from the scrubbing vessel at a temperature of 135° C and contains certain gas constituents, which are physically dissolved in the water, in the quantities stated in Column I of the following table in standard cubic meters per cubic meter.

| | I | II |
|---|---|---|
| $CO_2$ | 0.39 | 0.002 |
| CO | 0.21 | $5.7 \times 10^{-5}$ |
| $H_2$ | 0.25 | $8 \times 10^{-5}$ |
| $CH_4$ | 0.002 | $6.7 \times 10^{-7}$ |
| $H_2S$ | 0.125 | 0.002 |
| COS | 0.001 | $5.3 \times 10^{-6}$ |
| HCN | 0.098 | 0.0384 |
| $NH_3$ | 3.0 | 2.12 |

The aqueous liquor is fed to a preliminary flashing vessel in which a pressure of 1.4 bars is maintained. As a result, the aqueous liquor is cooled to 108° C. After the preliminary flashing, the aqueous liquor still contains dissolved gas constituents in the quantities stated in Column II of the above Table, also in standard cubic meters per cubic meter. Comparison of Columns I and II shows clearly that the polluting gas constitutents have been alsmot completely eliminated from the aqueous liquor by the preliminary flashing. Additional quantities of polluting gases are released by the subsequent flashing to atmospheric pressure. The gas released by the preliminary flashing is fed to a Claus process plant; this gas becomes available at a pressure high enough so that it can be fed to the Claus process plant without need for a compressor.

After the preliminary flashing the aqueous liquid is fed to a storage tank, in which the liquor is flashed to atmospheric pressure, whereby the water temperature is lowered to 99° C. Part of the water is evaporated by the final flashing so that most of the remaining gas constituents are stripped off. The water still contains the following residual quantities in standard cubic meters per cubic meter:

| | |
|---|---|
| $CO_2$ | $2.2 \times 10^{-5}$ |
| $H_2S$ | $6.3 \times 10^{-5}$ |
| HCN | 0.023 |
| $NH_3$ | 1.8 |

The other gas constituents are contained in the water only in negligibly small quantities. It is apparent that the water in the storage tank contains much less sulfur compounds than even the water that has been withdrawn from the preliminary flashing vessel. This water in the storage tank can now be subjected to sewage treatment without difficulty.

If the aqueous liquor withdrawn from the scrubbing vessel were directly flashed in the storage tank from 34 bars directly to 1 bar, the water vapor which becomes available in the storage tank would contain much more polluting gases, the partial pressure of these gas constituents would be much higher than after the two-stage flashing, and the water would retain a 100 to 200 times higher content of such gases. The gas constituents would be released mainly during the subsequent sewage treatment and would be highly polluting. Besides, the acid gas constituents would give rise to corrosion problems in the storage tank, the sewage treatment plant and the connecting conduits.

What is claimed is:

1. A proces of treating scrubbing water which has been used to scrub a hot raw gas produced by the gasification of a solid, liquid or gaseous fuel, which scrubbing water has dissolved therein hydrogen sulfide and additional gaseous pollutants, comprising flashing the used scrubbing water from a temperature of at least 100° C and a pressure of at least about 5 bars in at least one preliminary flashing stage to an intermediate pressure in the range of about 1.1 to 4 bars, separating the flashed-off gases containing the bulk of the hydrogen sulfide and pollutants from the residual scrubbing water, then flashing off the residual scrubbing water in a final flashing stage to atmospheric pressure, separating water vapor containing flashed-off gases from said final flashing stage, and treating said flashed-off gases from said final flashing stage separately from said gases from said preliminary flashing stage.

2. A process according to claim 1, wherein the initial used scrubbing water is flashed to an intermediate pressure in the range of abpit 1.2 to 3 bars.

3. A process according to claim 1, wherein the initial used scrubbing water in addition to hydrogen sulfide has dissolved therein at least one of the gaseous pollutants HCN, $NH_3$, $CO_2$, CO, and HCOOH, which gaseous pollutants are largely flashed off in the preliminary flashing.

4. A process according to claim 1, including the further step of feeding the gas which has been released by the preliminary flashing to a Claus process plant for removing sulfur compounds.

5. A process according to claim 4, wherein the initial used scrubbing water is initially under a pressure of about 10 to 80 bars and is flashed to an intermediate pressure of about 1.2 to 3 bars.

* * * * *